US008691051B2

(12) United States Patent
Gilberti et al.

(10) Patent No.: US 8,691,051 B2
(45) Date of Patent: Apr. 8, 2014

(54) SECURITY PAPER MATERIAL, IN PARTICULAR FOR LABELLING AND PACKAGING, AND MANUFACTURING METHOD THEREOF

(75) Inventors: Ferruccio Gilberti, Milan (IT); Luca Monacelli, Pordenone (IT); Francesco Pirola, Milan (IT)

(73) Assignee: Gruppo Cordenons S.p.A., Milan (IT)

( * ) Notice: Subject to any disclaimer, the term of this patent is extended or adjusted under 35 U.S.C. 154(b) by 0 days.

(21) Appl. No.: 12/296,339

(22) PCT Filed: Apr. 6, 2007

(86) PCT No.: PCT/IB2007/000920

§ 371 (c)(1),
(2), (4) Date: Jan. 23, 2009

(87) PCT Pub. No.: WO2007/116296

PCT Pub. Date: Oct. 18, 2007

(65) Prior Publication Data

US 2009/0173463 A1 Jul. 9, 2009

(30) Foreign Application Priority Data

Apr. 7, 2006 (IT) ..... MI06A0698

(51) Int. Cl.
*D21H 21/44* (2006.01)

(52) U.S. Cl.
USPC ..... 162/140; 162/124; 162/132

(58) Field of Classification Search
USPC ..... 162/103, 104, 140, 267, 268, 123–133; 283/67, 72, 82–83
See application file for complete search history.

(56) References Cited

U.S. PATENT DOCUMENTS

| | | | | | |
|---|---|---|---|---|---|
| 2,052,746 | A | * | 9/1936 | Bing | 162/133 |
| 2,286,924 | A | * | 6/1942 | Nicholson | 162/124 |
| 2,881,072 | A | * | 4/1959 | Clark | 162/104 |
| 2,881,669 | A | * | 4/1959 | Thomas et al. | 162/130 |
| 3,017,317 | A | * | 1/1962 | Voigtman et al. | 162/111 |
| 3,891,501 | A | * | 6/1975 | Oka et al. | 162/290 |
| 3,954,554 | A | * | 5/1976 | Curry et al. | 162/104 |
| 4,274,915 | A | * | 6/1981 | Munari | 162/129 |
| 4,756,557 | A | * | 7/1988 | Kaule et al. | 283/85 |

(Continued)

FOREIGN PATENT DOCUMENTS

| | | | |
|---|---|---|---|
| DE | 196 01 358 | A1 | 7/1996 |
| EP | 0 019 191 | A | 11/1980 |

(Continued)

OTHER PUBLICATIONS

English language translation of EP 1559832.*

(Continued)

*Primary Examiner* — Jose Fortuna
(74) *Attorney, Agent, or Firm* — Amster, Rothstein & Ebenstein LLP

(57) ABSTRACT

A manufacturing method of a security paper material, in particular for labelling and packaging, comprising the steps of forming a paper sheet from a wet cellulose fiber pulp and providing the paper sheet with electronic chips; the chips are introduced into the paper sheet being formed during the transformation step of the pulp into paper and are deposited directly onto the wet pulp and at least partially embedded in the pulp. Optionally, an auxiliary paper sheet is coupled to the paper sheet provided with the chips so that the chips are incorporated between the two sheets.

5 Claims, 1 Drawing Sheet

(56) References Cited

U.S. PATENT DOCUMENTS

| | | | | |
|---|---|---|---|---|
| 4,830,709 | A * | 5/1989 | Turner et al. | 162/133 |
| 5,064,502 | A * | 11/1991 | Turner | 162/299 |
| 6,855,228 | B1 * | 2/2005 | Perini | 162/112 |
| 7,988,825 | B2 * | 8/2011 | Aula et al. | 162/132 |
| 2002/0129913 | A1 * | 9/2002 | Leandersson | 162/132 |
| 2002/0162636 | A1 * | 11/2002 | Halmschlager et al. | 162/123 |
| 2003/0000666 | A1 * | 1/2003 | Mansson et al. | 162/123 |
| 2008/0121360 | A1 * | 5/2008 | Hietaniemi et al. | 162/130 |
| 2009/0165973 | A1 * | 7/2009 | Aula et al. | 162/133 |
| 2009/0173463 | A1 * | 7/2009 | Gilberti et al. | 162/140 |
| 2010/0230947 | A1 * | 9/2010 | Crane et al. | 283/108 |
| 2011/0133442 | A1 * | 6/2011 | Crane et al. | 283/71 |
| 2011/0215563 | A1 * | 9/2011 | Rancien et al. | 283/113 |

FOREIGN PATENT DOCUMENTS

| | | | |
|---|---|---|---|
| EP | 1 559 832 | A | 8/2005 |
| EP | 1559832 | A2 | 8/2005 |
| GB | 1 365 876 | A | 9/1974 |
| GB | 2 395 724 | A | 6/2004 |
| JP | 2002-298118 | | 10/2002 |
| JP | 2002-319006 | | 10/2002 |
| JP | 2005-134023 | | 5/2005 |
| JP | 2005-209009 | | 8/2005 |
| JP | 2005-350823 | | 12/2005 |
| JP | 2006-307393 | | 11/2006 |
| WO | 03015016 | A | 2/2003 |
| WO | WO 2007116296 | A2 * | 10/2007 |

OTHER PUBLICATIONS

Chinese Office Action dated Jun. 11, 2010 for Application No. 200780015398.4.

International Search Report of Oct. 2007.

* cited by examiner

SECURITY PAPER MATERIAL, IN PARTICULAR FOR LABELLING AND PACKAGING, AND MANUFACTURING METHOD THEREOF

This application is a national stage application of co-pending PCT application PCT/IB2007/000920 filed Apr. 6, 2007. The disclosure of this application is expressly incorporated herein by reference in its entirety.

TECHNICAL FIELD

The present invention relates to a security paper material, in particular for labelling and packaging, and to the manufacturing method thereof.

BACKGROUND ART

There are known various so-called security papers, i.e. provided with various artifices having the function of either avoiding or detecting a possible fraudulent copy or forgery; specifically, security papers provided with electronic chips capable of outputting an identification signal are known.

In the known security papers, the chips are applied onto a support, which is then glued or otherwise fixed onto the previously formed paper sheet.

This type of security paper is not free from drawbacks, both because the application of the chips is relatively complicated and costly, and because the chips cannot be appropriately anchored to the paper sheet underneath, and furthermore remain exposed on the surface of the paper sheet and are thus subject to possible damage, unless the chips are coated with a protective layer which however implies an increase of complexity and cost of the manufacturing process.

DISCLOSURE OF INVENTION

It is an object of the present invention to provide a security paper material, of the type formed by a paper sheet with an electronic identification chip, which is free from the above-mentioned drawbacks of the known art; in particular, it is an object of the present invention to provide a security paper material which is relatively simple and cost-effective to manufacture and in which the chip is firmly and efficiently anchored to the paper sheet.

The present invention thus relates to a security paper material, in particular for labelling and packaging, comprising a paper sheet provided with at least one electronic chip and characterised in that the chip has been introduced in the paper sheet being formed during the manufacturing step of the paper sheet and is at least partially embedded in the paper sheet.

According to a preferred embodiment of the invention, the paper material further comprises an auxiliary paper sheet coupled to the paper sheet, and the chip is incorporated between the two sheets.

The invention further relates to a manufacturing method of a security paper material, in particular for labelling and packaging, comprising the steps of forming a paper sheet from a wet cellulose fibre pulp and providing the paper sheet with electronic chips; the method being characterised in that the chips are introduced into the paper sheet being formed during the transformation step of the pulp into paper, the chips being deposited directly onto the wet pulp and at least partially embedded in the pulp.

Specifically, the method provides the steps of feeding the wet cellulose fibre pulp to a papermaking machine, depositing the pulp on a forming table; and forming a sheet of paper by gradually subtracting water from the pulp; the chips are deposited in the pulp directly onto the forming table on an upper side of the paper sheet being formed.

Preferably, the chips are fed by a dispensing device arranged over the forming table and are dropped by gravity onto the pulp.

According to a preferred embodiment, the method further comprises, after the step of introducing the chips into the paper sheet being formed, a step of coupling an auxiliary paper sheet to said paper sheet; the chips are applied onto an upper side of the paper sheet being formed, and the auxiliary paper sheet is coupled to said side.

BRIEF DESCRIPTION OF THE DRAWINGS

The invention is further described in the following non-limitative example of embodiment, with reference to the accompanying drawings, in which.

BEST MODE FOR CARRYING OUT THE INVENTION

Figure 1:
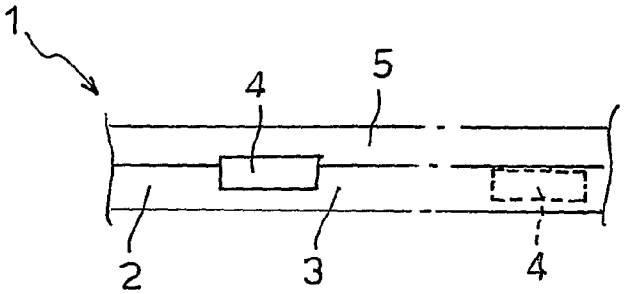
FIG. 1 is a diagrammatic longitudinal section view of a security paper material according to the invention.

With reference to FIG. 1, a security paper material, specifically for labelling and packaging, comprises a paper sheet 2 formed by a cellulose fibre matrix 3 and provided with at least one electronic chip 4 of known type, e.g. an active and/or passive RFID chip.

Chip 4 is at least partially embedded in paper sheet 2 (as shown by a solid line in the left part of FIG. 1) and, preferably, is entirely embedded in matrix 3 (as shown by a dotted line in the right part of FIG. 1).

Optionally, paper material 1 comprises an auxiliary paper sheet 5 coupled to paper sheet 2 and chip 4 is incorporated between auxiliary sheet 5 and paper sheet 2.

Figure 2:
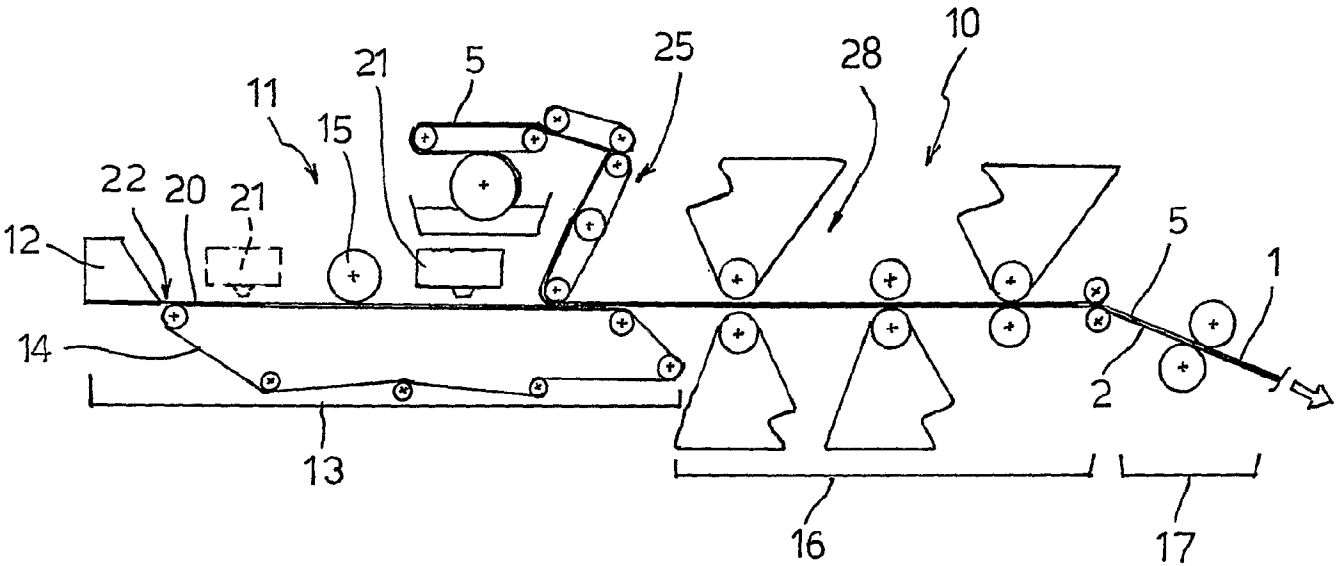
FIG. 2 is a diagrammatic view of a manufacturing system of the security paper material in FIG. 1 and illustrates the main steps of the manufacturing method of such material.

Paper material 1 is advantageously made, in accordance with a further aspect of the present invention, by the method described hereafter with reference to FIG. 2, which diagrammatically shows a manufacturing system 10 of paper material 1.

System 10 comprises a Fourdrinier type continuous papermaking machine 11, essentially known and not described in detail for the sake of simplicity. In general terms, papermaking machine 11 comprises a headbox 12 for feeding a wet cellulose fibre pulp to a flat forming table 13 having a formation fabric 14 on which the pulp is deposited; papermaking machine 11 further comprises a table roll 15 cooperating with forming fabric 14, a so-called "wet end" 16 and a dryer section 17. As known, the progressive subtraction of water from the wet pulp gradually transforms the pulp into a paper sheet. The paper sheet being formed is indicated by numeral 20 in FIG. 2 and will form, once dry, paper sheet 2 of above-described paper material 1.

After an initial part of forming table 13 near headbox 12, and downstream of table roll 15, there is arranged over forming table 13, a dispensing device 21 which deposits chips 4 on the pulp, at predetermined intervals both in the direction of advancement of the paper sheet 20 being formed and in transversal direction. Specifically, chips 4 are dropped by gravity onto the pulp carried by forming fabric 14 onto an upper side 22 of paper sheet being formed 20 and are at least partially embedded in the pulp.

Chips 4 are thus introduced into the paper sheet being formed 20 during the step of transforming the wet cellulose fibre pulp into paper.

Immediately downstream of dispensing device 21, a mechanism 25 carries auxiliary paper sheet 5 into contact with side 22 of paper sheet 20 being formed and makes the coupling of the latter with auxiliary paper sheet 5.

A wet rolling step follows, performed by means of a rolling assembly 28 arranged in wet part 16 and having for example two or more counterpoised pairs of rolls; the wet rolling of paper sheet 20 being formed with auxiliary paper sheet 5, the latter also still wet, ensures the adhesion of the two sheets.

The formation of paper sheet 2 and thus of paper material 1 is completed by passing through wet end 16 and drier section 17.

According to a variant, table roll 15 is absent from the papermaking machine 11 and dispensing device 21 is arranged on forming table 13 upstream of mechanism 25; indeed, the coupling with auxiliary paper sheet 5 makes the use of table roll 15 on forming table 13 unnecessary, as it is not required to improve the surface properties of the paper sheet 20 being formed (onto which auxiliary paper sheet 5 is placed).

According to a further variant, dispensing device 21 is arranged after the initial part of forming table 13 next to headbox 12 and upstream of table roll 15 instead of downstream of table roll 15, as shown by a dotted line in FIG. 2. Obviously, if table roll 15 is missing, dispensing device 21 is arranged on forming table 13 between headbox 12 and mechanism 25.

The advantages of the present invention are apparent from the description above.

The paper material of the invention allows a rapid, secure identification by querying the chip incorporated in the material itself.

The chips are perfectly incorporated and firmly fixed within the material, thus protected from possible damage.

Furthermore, the paper material of the invention is perfectly printable with the usual printing techniques offering high printing quality.

Moreover, the manufacturing method is simple and cost-effective, specifically as the introduction of the chips is performed directly during the manufacturing step of the paper material.

The invention claimed is:

1. A method for manufacturing a security paper material comprising the steps of forming a paper sheet from a wet cellulose fibre pulp and providing the paper sheet with electronic chips, the electronic chips being introduced into the paper sheet being formed during transformation of the wet cellulose fibre pulp into paper, the electronic chips being deposited directly onto the wet cellulose fibre pulp and at least partially embedded in the wet cellulose fibre pulp, comprising the steps of:

feeding the wet cellulose fibre pulp to a Fourdrinier type continuous papermaking machine;

depositing the wet cellulose fibre pulp on a flat forming table that defines a horizontal plane;

forming the paper sheet by gradually subtracting water from the wet cellulose fibre pulp, the electronic chips being deposited in the wet cellulose fibre pulp directly onto the flat forming table on an upper side of the paper sheet being formed and on a flat and horizontal surface of the paper sheet on the flat forming table and being fed by a dispensing device arranged over the flat forming table and being dropped in free fall by gravity onto the wet cellulose fibre pulp, wherein the electronic chips are deposited on the wet cellulose fibre pulp by the dispensing device at predetermined intervals both in a direction of advancement of the paper sheet being formed and in a transversal direction;

coupling an auxiliary paper sheet to the upper side of the paper sheet being formed, wherein the coupling is performed after depositing the chips in the wet cellulose fibre pulp and while both the paper sheet being formed and the auxiliary paper sheet are still wet and lie on the flat forming table; and wet rolling the paper sheet being formed and the auxiliary paper sheet, while they both are still wet and disposed within the horizontal plane, by means of a rolling assembly having two or more counterpoised pairs of rolls, wherein the paper sheet is not press rolled before being coupled with the auxiliary sheet.

2. The method of claim 1, further comprising entirely embedding the electronic chips in the wet cellulose fibre pulp.

3. A method comprising:

feeding a wet cellulose fibre pulp to a papermaking machine;

depositing the wet cellulose pulp on a flat forming table that defines a horizontal plane;

forming a sheet of paper by gradually subtracting water from the wet cellulose pulp;

depositing electronic chips in the wet cellulose fibre pulp on the flat forming table during the forming the sheet of paper, wherein the depositing the electronic chips in the wet cellulose fibre pulp comprises dropping the electronic chips in free fall onto the wet cellulose fibre pulp in such a way the electronic chips are entirely embedded in the wet cellulose fibre pulp only by effect of gravity;

coupling an auxiliary paper sheet to the upper side of the paper sheet being formed, wherein the coupling is performed after depositing the chips in the wet cellulose fibre pulp and while both the paper sheet being formed and the auxiliary paper sheet are still wet and lie on the flat forming table; and wet rolling the paper sheet being formed and the auxiliary paper sheet, while they both are still wet and disposed within the horizontal plane, by means of a rolling assembly having two or more counterpoised pairs of rolls, wherein the paper sheet is not press rolled before being coupled with the auxiliary sheet.

4. The method of claim 3, wherein the papermaking machine is a Fourdrinier type continuous papermaking machine.

5. The method of claim 3, wherein the depositing the electronic chips in the wet cellulose fibre pulp further comprises dispensing the electronic chips from a dispensing device at predetermined intervals both in a direction of advancement of the paper sheet being formed and in a transversal direction.

* * * * *